US008007295B2

(12) United States Patent
Lin

(10) Patent No.: US 8,007,295 B2
(45) Date of Patent: Aug. 30, 2011

(54) ROTATABLE AND CONCEALABLE ELECTRICAL POWER RECEPTACLE

(75) Inventor: Mei-Ju Lin, Tucheng (TW)

(73) Assignee: Powertech Industrial Co., Ltd., Taipei Hsien (TW)

( * ) Notice: Subject to any disclaimer, the term of this patent is extended or adjusted under 35 U.S.C. 154(b) by 0 days.

(21) Appl. No.: 12/759,222

(22) Filed: Apr. 13, 2010

(65) Prior Publication Data

US 2011/0177703 A1 Jul. 21, 2011

(30) Foreign Application Priority Data

Jan. 20, 2010 (TW) ..... 99101500 A

(51) Int. Cl.
*H01R 13/44* (2006.01)

(52) U.S. Cl. ..... 439/131

(58) Field of Classification Search ..... 439/131
See application file for complete search history.

(56) References Cited

U.S. PATENT DOCUMENTS 3,131,512 A * 5/1964 Macleod, Jr. ..... 52/220.5
3,189,862 A * 6/1965 Vleerick et al. ..... 439/131
3,622,684 A * 11/1971 Press ..... 174/486
4,372,629 A * 2/1983 Propst et al. ..... 312/223.6
4,792,881 A * 12/1988 Wilson et al. ..... 361/827
4,984,982 A * 1/1991 Brownlie et al. ..... 439/131
5,122,069 A * 6/1992 Brownlie et al. ..... 439/131
5,230,552 A * 7/1993 Schipper et al. ..... 312/223.6
5,342,993 A * 8/1994 Siems ..... 174/481
5,575,668 A * 11/1996 Timmerman ..... 439/131
5,709,156 A * 1/1998 Gevaert et al. ..... 108/50.02
6,028,267 A * 2/2000 Byrne ..... 174/59
6,046,405 A * 4/2000 Obermann ..... 174/57
6,085,667 A * 7/2000 Gevaert et al. ..... 108/50.02
6,273,735 B1 * 8/2001 Johnson et al. ..... 439/131
6,290,518 B1 * 9/2001 Byrne ..... 439/131
6,549,789 B1 * 4/2003 Kfoury ..... 455/550.1
6,830,456 B2 * 12/2004 Obermeyer ..... 439/6
6,867,961 B2 * 3/2005 Choi ..... 361/679.06
6,942,502 B2 * 9/2005 Sharples ..... 439/131
6,979,209 B2 * 12/2005 Griepentrog ..... 439/131
7,094,059 B2 * 8/2006 Obermeyer ..... 439/6
7,544,101 B1 * 6/2009 Tseng ..... 439/668
7,621,764 B2 * 11/2009 Shunjie ..... 439/131
7,736,178 B2 * 6/2010 Byrne ..... 439/574
2004/0147147 A1 * 7/2004 Griepentrog ..... 439/131
2008/0032528 A1 * 2/2008 Lai ..... 439/131
2008/0200050 A1 * 8/2008 Byrne ..... 439/131

* cited by examiner

*Primary Examiner* — Ross N Gushi
(74) *Attorney, Agent, or Firm* — Kile Goekjian Reed & McManus PLLC

(57) ABSTRACT

Disclosed is a reversible and concealable electrical power receptacle, comprising: a main body, a shaft section, an accommodating section, and an electrical outlet assembly. The electrical outlet assembly is disposed on the main body; the accommodating section is for receiving the main body; the shaft section, comprises a first shaft member and a second shaft member. The second shaft member, being coupled to the main body and is perpendicular to the first shaft member, and the main body is rotatable with respect to the first and the second shaft members transversely respectively. Consequently, the main body is able to rotate transversely and perpendicularly with respect to the accommodating section in accordance with the rotational movements of the first shaft and the second shaft members, for resulting in an exposed state in use or a concealed state when not in use, thereby achieving effective space utilization.

10 Claims, 5 Drawing Sheets

ROTATABLE AND CONCEALABLE ELECTRICAL POWER RECEPTACLE

BACKGROUND OF THE INVENTION

1. Field of the Invention

The present invention relates to an electrical power receptacle, in particular, to an electrical power receptacle which is rotatable and concealable.

2. Description of Related Art

With the present continuous development of modern society, more and more electronic devices are utilized in public. To operate the electronic devices, electrical power supplies are required to drive the electronic devices. Generally speaking, each electronic device requires at least one power cable for connecting to an electrical socket to receive public electrical power. Thus, as a variety of electronic devices require their own power cables for connecting to electrical sockets, the plurality of power cables extending out from their own main body to the electrical sockets causes the operating platform and the use of space to be in a mass and not tidy.

In addition, standard electrical extension outlets, connected to the public electrical power distribution system, are usually arbitrarily placed on the ground anywhere. In general, by utilizing the conventional electrical extension outlets, users are required to adjust positions, e.g. bending or walking to be close to the location which placed the conventional electrical extension outlets, for completing the action to plug an electrical plug into any one of the outlets. As such, the conventional electrical power outlets are not comfort in use and lacking the degree of convenience of use.

SUMMARY OF THE INVENTION

In view of the aforementioned issues, a primary objective of the present invention is to provide a rotatable and concealable electrical power receptacle in accordance with the structural design thereof for solving the inconvenience of use associated with the conventional electrical power outlet. The rotatable and concealable electrical power receptacle according to the present invention is rotatable to an exposed state in use or a concealed state when not in use, so that the overall space of use can be maintained in a tidy appearance. Moreover, the rotatable and concealable electrical power receptacle according to the present invention simplifies the structure design, thereby decreasing the overall manufacturing cost.

To solve the aforementioned issues, an embodiment of a rotatable and concealable electrical power receptacle according to the present invention, comprising: a main body, a shaft section, an accommodating section, and at least one electrical outlet assembly. The electrical outlet assembly is disposed on the main body; the accommodating section is for receiving the main body; the shaft section, coupled to the main body, includes a first shaft member and a second shaft member; the first shaft member is capable of carrying along the main body engaged with the first shaft member to rotate with respect to a axis of the first shaft member transversely; the second shaft member, coupled to the accommodating section and the first shaft member, is perpendicular to the first shaft member, such that the first shaft member engaged with the second shaft member is rotatable with respect to a axis of the second shaft member transversely. Substantially, the main body incorporates with the two-dimensional rotational movement in accordance with the first shaft member and the second shaft member is capable of rotating transversely and perpendicularly to an exposed state in use or a concealed state when not in use, thereby increasing the flexibility of use.

Consequently, the aforementioned rotatable and concealable electrical power receptacle according to the present invention with a simplified design and low manufacturing cost is capable of rotating, exposing, and concealing in conjunction with the requirements of applications. Moreover, the rotatable and concealable electrical power receptacle is configured to be positioned adjacent to users in response to considerations of enhancing the convenience degree of use, e.g. tabletop, for preventing the users to perform additional actions, e.g. bending to the ground. While the electrical outlet assembly is required, the main body of the rotatable and concealable electrical power receptacle can be pulled out from the accommodating section and is able to rotate and then fold it down to be aligned to the horizontal plane of the accommodating section in accordance with the rotational movements of two shafts provided by the shaft section; on the other hand, while the electrical outlet assembly is not in use, the main body of the rotatable and concealable electrical power receptacle can be pulled out, so that the main body is capable of rotating of 180 degrees horizontally and then rotate vertically to be received entirely in a space formed inside the accommodating section in accordance with the two shafts, thereby maintaining the space of use in a tidy appearance.

In order to further understand the techniques, means and effects the present invention takes for achieving the prescribed objectives, the following detailed description and included drawings are hereby referred, such that, through which, the purposes, features and aspects of the present invention can be thoroughly and concretely appreciated; however, the included drawings are provided solely for reference and illustration, without any intention to be used for limiting the present invention, whose full scope and dimension is described only in the later following claims.

DETAILED DESCRIPTION OF THE PREFERRED EMBODIMENTS

The present invention provides a rotatable and concealable electrical power receptacle. As per the structural design perspective view, the electrical power receptacle can be concealed when not in use so as to maintain the space of use in a tidy appearance; the rotatable and concealable electrical power receptacle can be disposed on a tabletop, such that users are not required to take any additional actions, e.g. bending or walking, for utilizing the rotatable and concealable electrical power receptacle with respect to considerations of comfort in use and convenience of use.

Figure 1:
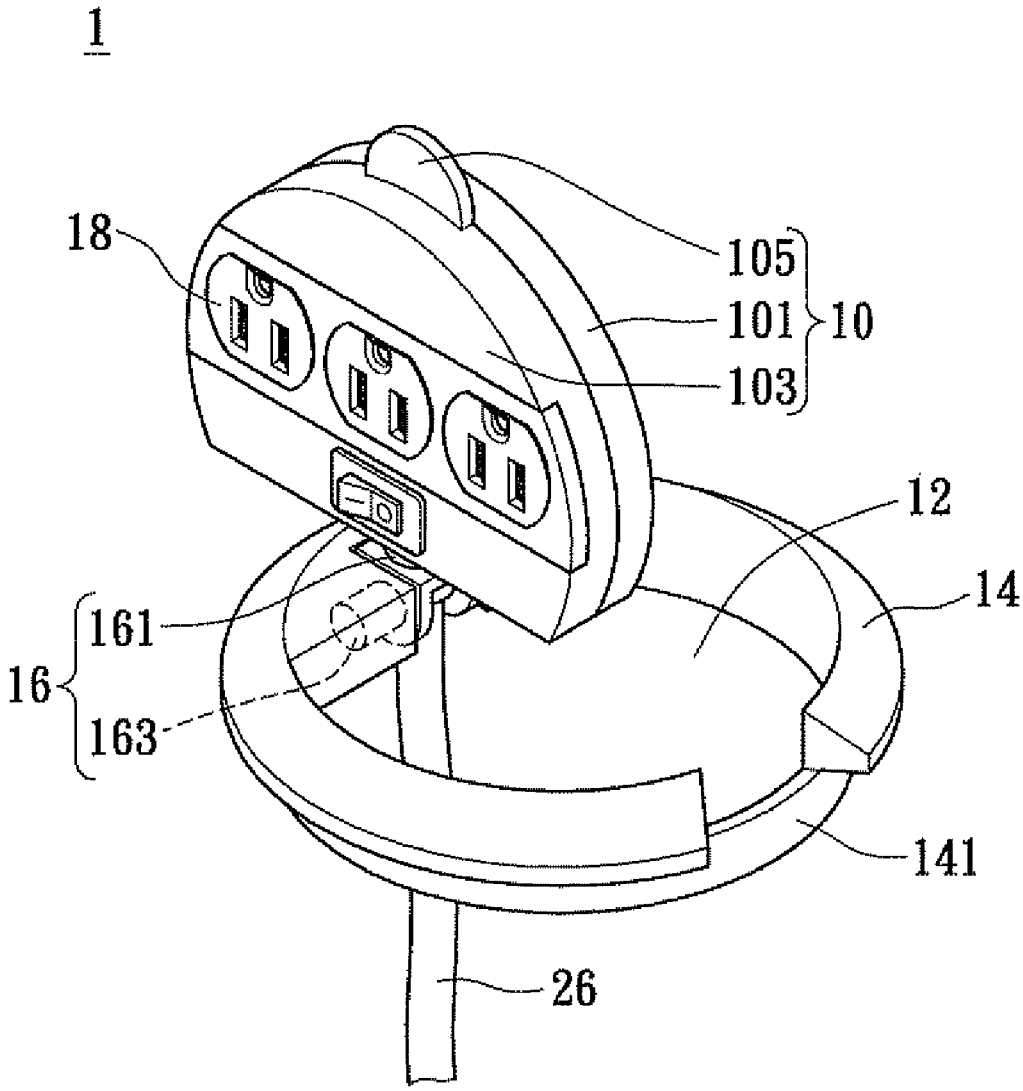
FIG. 1 illustrates an exploded diagram of a first embodiment of the rotatable and concealable electrical power receptacle in accordance with certain aspects of the present technique.

First please refer to FIG. 1, in which an exploded diagram of a first embodiment of the rotatable and concealable electrical power receptacle in accordance with certain aspects of the present technique is demonstrated. A rotatable and concealable electrical power receptacle 1 comprises: a main body 10, a shaft section 16, an accommodating section 14, and at least one electrical outlet assembly 18. The main body 10 further includes a first housing member 101, a second housing member 103, and a pulling member 105. The shaft section 16 further includes a first shaft member 161 and a second shaft member 163. The first shaft member 161 contains an electrical power cable 26 disposed inside it. The accommodating section 14 has an interior space forming as a receiving space 12 and incorporates with the pulling member 105 to dispose an accommodating space 141 for receiving the pulling member 105. The accommodating space 141 is adjacent to the receiving space 12.

The first housing member 101 and the second housing member 103 are coupled to each other to from the main body 10. On the main body 10, there are a plurality of electrical outlet assemblies 18 are disposed on it. In the embodiment, the plurality of the electrical outlet assemblies 18 are disposed on the second housing member 103, but not limited thereto. The first shaft member 161 coupled to the main body 10 is capable of rotating transversely, so that the main body 10 and the electrical outlet assemblies 18 are substantially rotatable with respect to the central axis of the first shaft member 161 in a clockwise or a counterclockwise direction in any angle transversely. The second shaft member 163 coupled to the accommodating section 14 and the first shaft member 161 is perpendicular to the first shaft member 161, i.e. the axis of the first shaft member 161 is perpendicular to the axis of the second shaft member 163. The first shaft member 161 is capable of not only rotating transversely but also rotating with respect to the central axis of the second shaft member 163 perpendicularly. The receiving space 12 surrounded by the accommodating section 14 is able to receive the main body 10 entirely. As such, the rotatable and concealable electrical power receptacle 1 is rotatable to an exposed state in use or a concealed state when not in use by the engagement between the first shaft section 161 and the second shaft section 163, thereby increasing the flexibility of use. Furthermore, the electrical power cable 26 disposed inside the first shaft member 161 is not conflicted with the rotational movements associated with the first shaft member 161 and the second shaft member 163 in two dimensions. In other words, the electrical power cable 26 will not be knotted or damaged due to the rotational movements of the first shaft member 161 and the second shaft member 163, thereby substantially extending the service life of the rotatable and concealable electrical power receptacle 1.

An action by pulling up the rotatable and concealable electrical power receptacle 1 is by applying an external force on the pulling member 105 disposed on a periphery of the main body 10, so that the external force incorporate with the shaft section 16 forms a perpendicular force torque. The main body 10 is pulled and moved a position perpendicularly in response to the force torque. It is worth to mention that the farther the pulling member 105 is disposed away from the shaft section 16, the easier the main body 10 is rotated and moved by users. Moreover, the accommodating space 141 is designed to receive the pulling member 105 and is applicable for allowing user's hands or other tools to apply force on the pulling section 105 so as to make the main body 10 rotate.

Figure 2A:
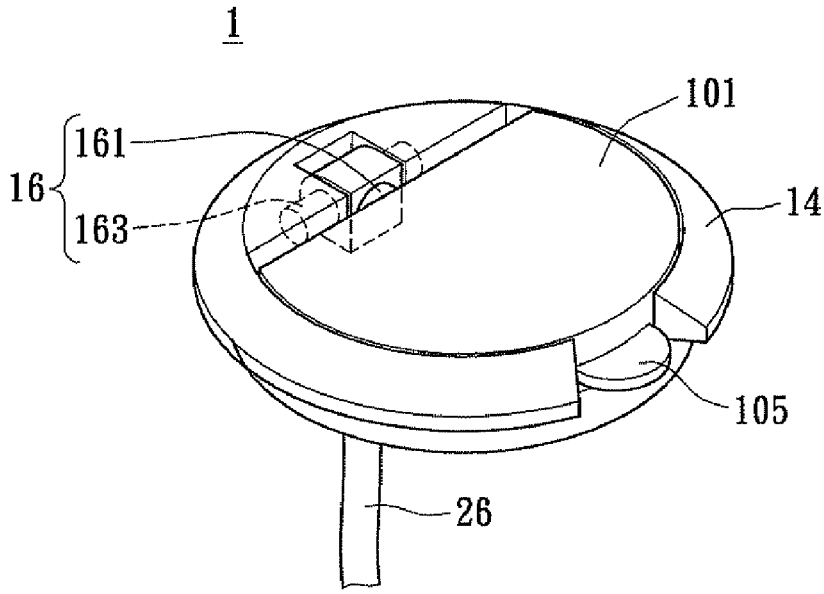
FIG. 2A illustrates a first mode of use diagram of the first embodiment in accordance with the rotatable and concealable electrical power receptacle according to the present invention.
Figure 2B:
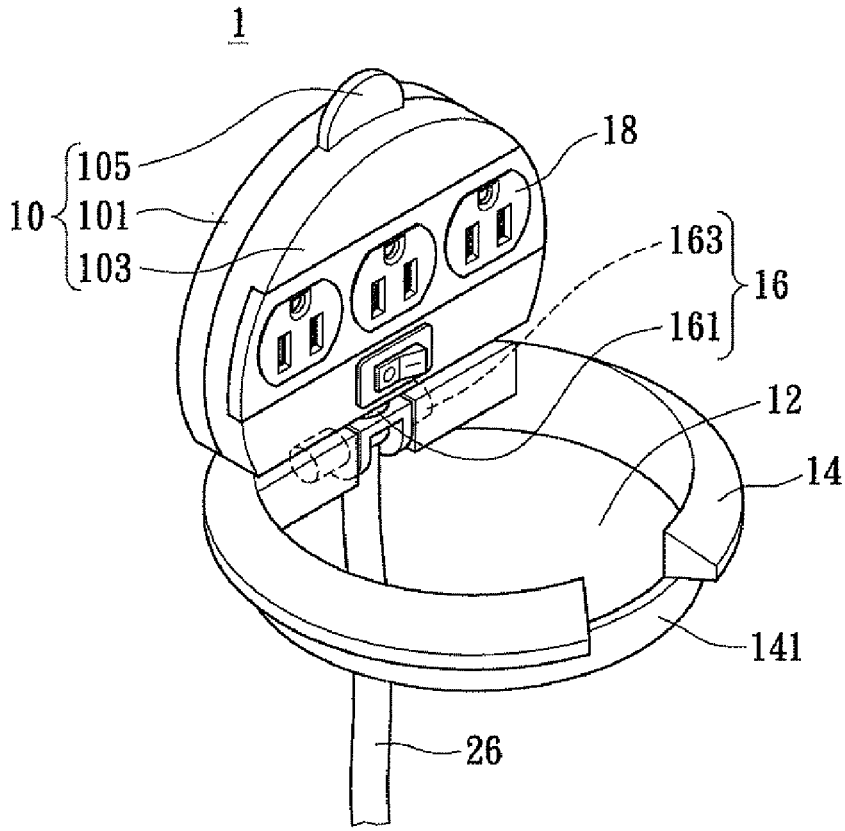
FIG. 2B illustrates a second mode of use diagram of the first embodiment in accordance with the rotatable and concealable electrical power receptacle according to the present invention.

In the preferred embodiment, schematic diagrams of the rotatable and concealable electrical power receptacle in different steps of use are shown in FIG. 2A till FIG. 2B.

Please refer to FIG. 2A in conjunction with FIG. 1, in which a first mode of use of the first embodiment in accordance with the rotatable and concealable electrical power receptacle according to the present invention is demonstrated. The first mode of use is the concealed state, in which the main body 10 and the electrical outlet assemblies 18 on it are completed concealed in the receiving space 12 and an outer surface of the first housing member 101 is aligned to an upper peripheral surface of the accommodating section 14 in the same horizontal plane. As the rotatable and concealable electrical power receptacle 1 is in the concealed state, the first housing member 101 is facing upward and the second housing member 103 is actually facing downward. As such, the electrical outlet assemblies disposed on the second housing member 103 in the preferred embodiment are applicable for connecting power cables beneath the main body 10. Therefore, as per the perspective view of the first housing member 101, the connection of power cables applied with the electrical outlet assemblies 18 are not exposed outside, i.e. in the concealed mode, thereby maintaining the space of use in a tidy appearance. Moreover, because the outer surface of the first housing member 101 and the upper peripheral surface of the accommodating section 14 are aligned in the same level, the outer surface of the rotatable and the concealable electrical power receptacle 1 is adapted for users to place objects or utilize the surface without affecting working efficiency.

Next, please refer to FIG. 2B in conjunction with FIG. 2A, in which a second mode of use of the first embodiment in accordance with the rotatable and concealable electrical power receptacle is demonstrated. In the concealed state in FIG. 2A, an external force is applied on the pulling member 105 to make the main body 10 to rotate with respect to the rotational movement of the second shaft section 163 around 90 degrees, i.e. the second mode of use as shown in FIG. 28. In the mode, the main body 10 is moved and disengaged from the receiving space 1 and the electrical power cable 26 coupled to the electrical outlet assembly 18 and disposed inside the first shaft member 161 is not conflicting with the rotational movement of the first shaft member 161.

Figure 2C:
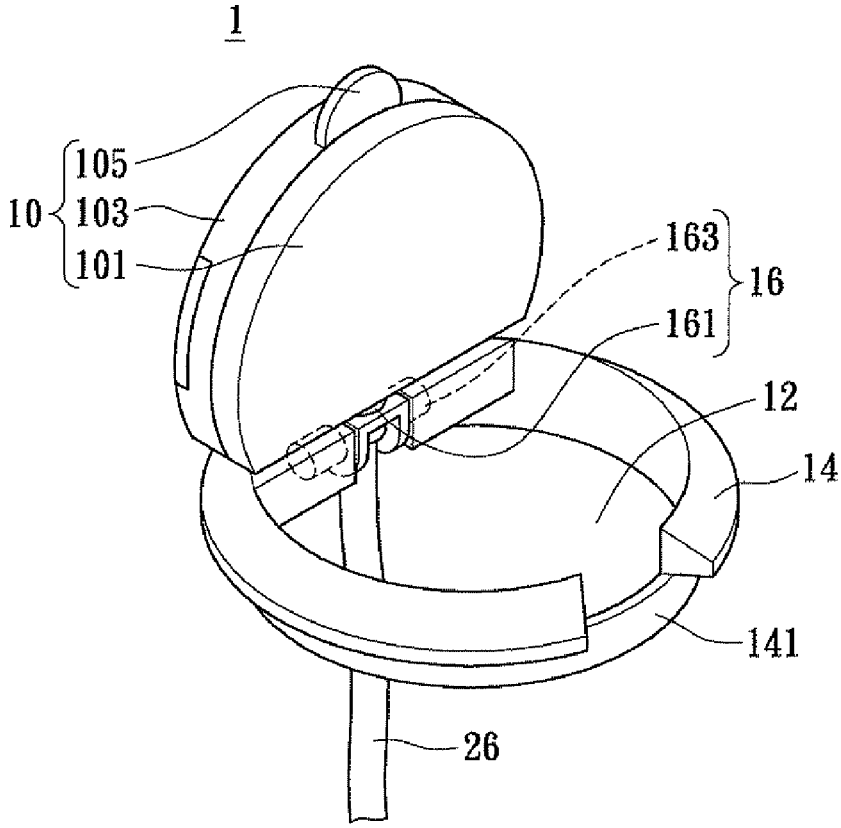
FIG. 2C illustrates a third mode of use diagram of the first embodiment in accordance with the rotatable and concealable electrical power receptacle according to the present invention.

Further, please refer to FIG. 2C in conjunction with FIG. 2B, in which a third mode of use of the first embodiment in accordance with the rotatable and concealable electrical power receptacle is demonstrated. As the rotatable and concealable electrical power receptacle 1 is in the second mode, the main body 10 is capable of rotating along the axis of the first shaft member 161 around 180 degrees without restrictions in rotating directions, e.g. clockwise direction or counterclockwise direction. It is worth to mention that the electrical power cable 26 contained inside the first shaft member 161 is not knotted or damaged in response to the rotations of the first shaft member 161.

Figure 2D:
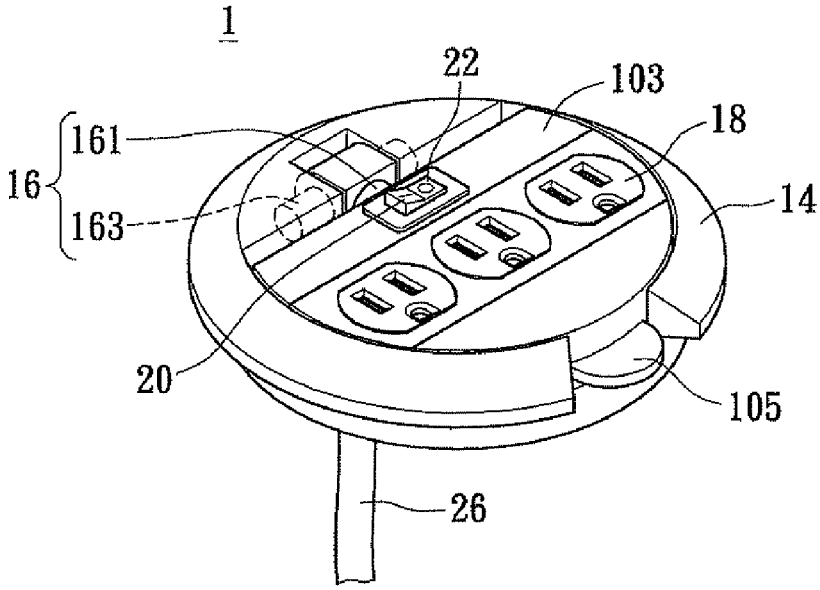
FIG. 2D illustrates a fourth mode of use diagram of the first embodiment in accordance with the rotatable and concealable electrical power receptacle according to the present invention.

Then, please refer to FIG. 2D in conjunction with FIG. 2C, in which a fourth mode of use of the first embodiment in accordance with the rotatable and concealable electrical power receptacle is demonstrated. When the rotatable and concealable electrical power receptacle 1 is in the third mode of use, it only requires to simply apply an external force toward the accommodating section direction on the main body 10, so that a perpendicular force torque downward is generated to make the main body 10 rotate downward with respect to the second shaft member 163. Thus, under the situation, the first housing 101 is now facing downward and engages with the accommodating section 14 for making the main body 10 to be held still. And the second housing member 103 and the electrical outlet assemblies 18 disposed on it are facing outward and are exposed outside. In the fourth mode of use, i.e. the exposed state, the power cables are able to connect to the exposed electrical outlet assemblies 18 for retrieving electrical power easily. When not in use, the rotatable and concealable electrical power receptacle 1 according to the preferred embodiment can be back from the fourth mode of use, i.e. the exposed state to the first mode of use, i.e. the concealed state. First, pull the main body 10 up in 90 degrees perpendicularly, then rotate the main body horizontally around 180 degrees, and then rotate the main body 10 downward to allow it to be received completely by the receiving space 12.

In the embodiment, a power switch 20 and an indicator 22 are additionally disposed on the second housing member 103. As the power switch 20 is on and the indicator 22 emits light, it represents that the electrical power receptacle 1 is in a conduction state or functions normally; conversely, as the power switch 20 is off and the indicator 22 doesn't emit light, it represents that the electrical power receptacle 1 is in a cutoff state or functions abnormally.

Figure 3:
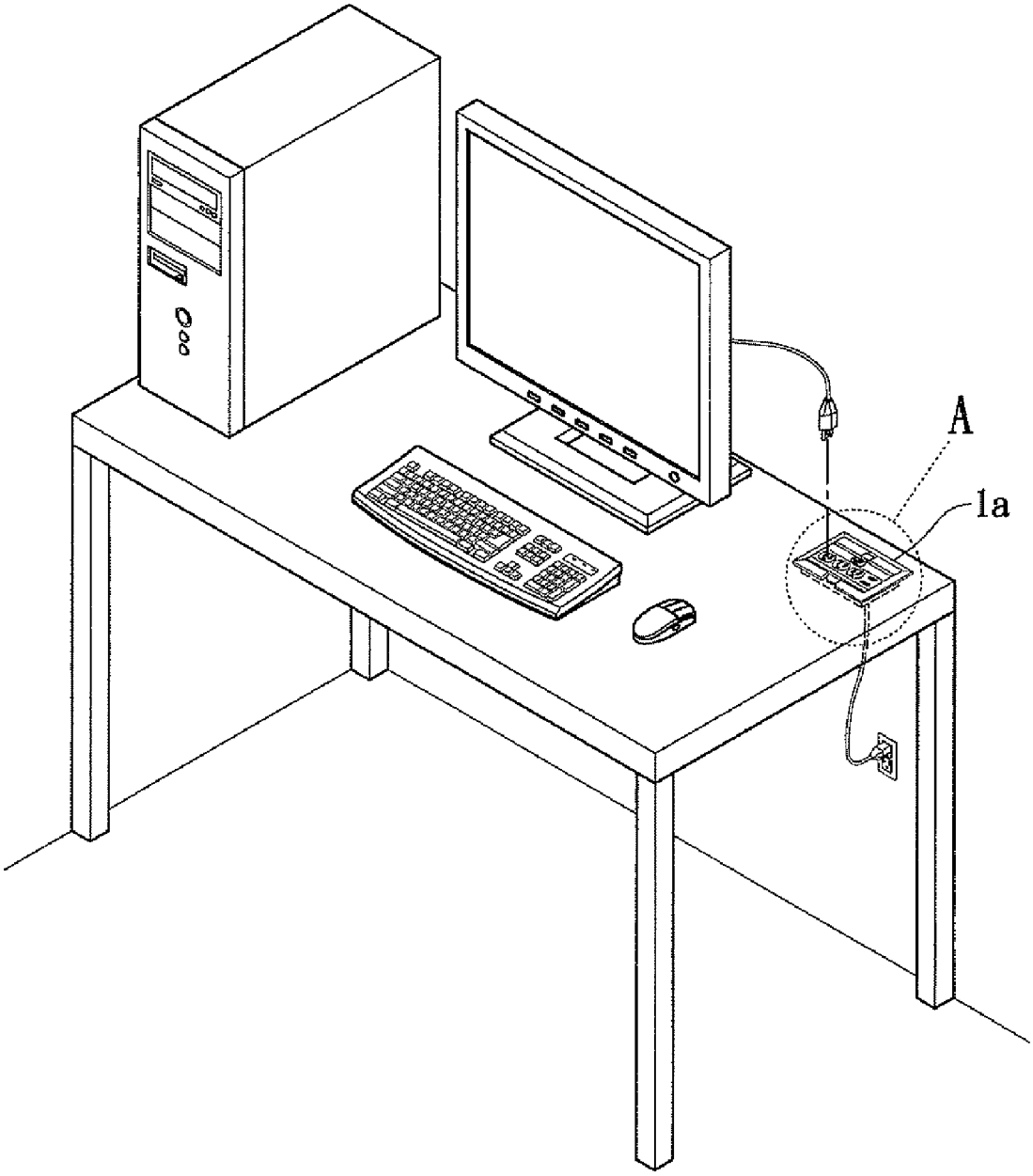
FIG. 3 illustrates a diagram of a second embodiment in accordance with the rotatable and concealable electrical power receptacle according to the present invention in use.
Figure 3A:
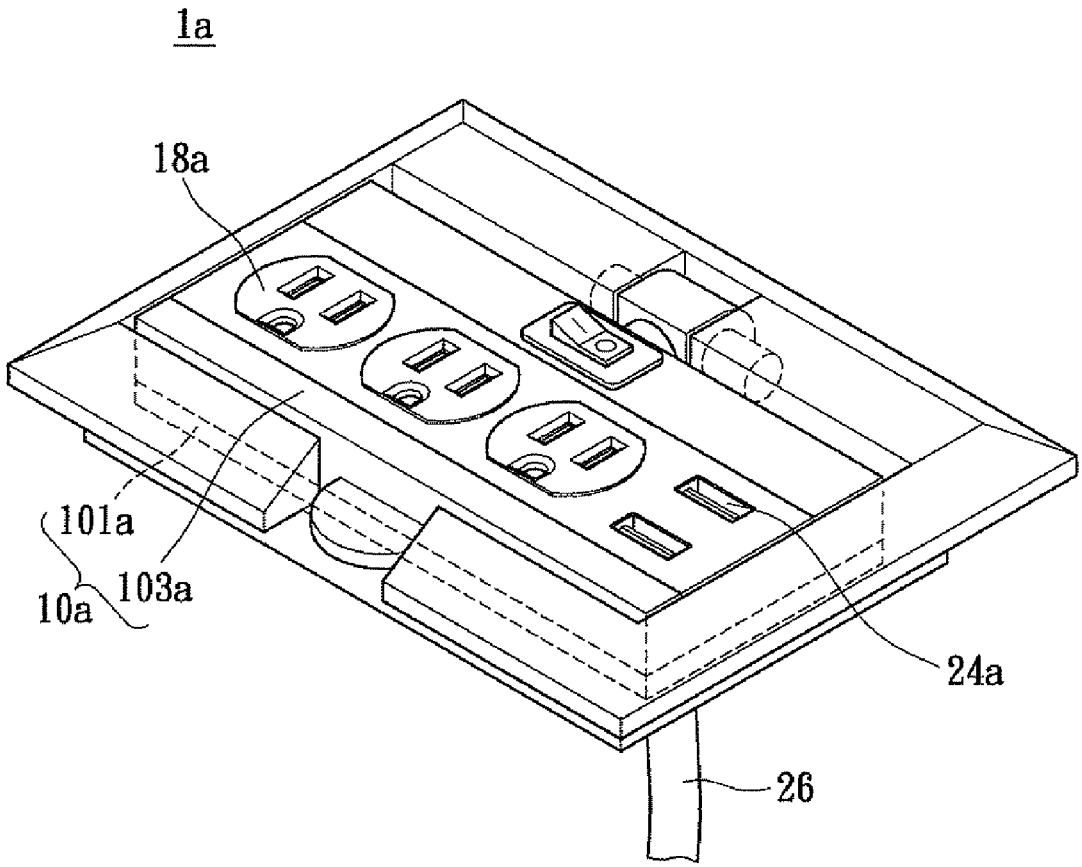
FIG. 3A illustrates an exploded diagram of the portion A of FIG. 3 according to the present invention.

Finally, please refer to FIG. 3 in conjunction with FIG. 3A, in which a diagram of a second embodiment in accordance with the rotatable and concealable electrical power receptacle according to the present invention in use is demonstrated. Further, the FIG. 3A is an exploded diagram of the A portion in FIG. 3. In the embodiment, components and their connection relationship of the rotatable and concealable electrical power receptacle 1*a* are identical with that shown in FIG. 1. However, as per the embodiment shown in FIG. 3 and FIG. 3A, the electrical outlet assemblies 18*a* may include not only electrical outlets but also USB jack assemblies 24*a*. The USB jack assemblies 24*a* may be disposed on the main body 10, either on the first housing member 101*a* or the second housing member 103*a*. The quantity of the USB jack assemblies 24*a* and the configuration in series or in parallel order in accordance with the embodiment is merely for illustration, but it not limited thereto. The main body 10*a* may be of an irregular shape, an triangular shape, a circular shape, or a rectangular shape. As per the embodiment, the main body 10*a* is of a rectangular shape and the rotatable and concealable electrical power receptacle 1*a* disposed on a tabletop is able to rotate to expose out of the tabletop in use or concealed underneath the tabletop when not in use.

When electrical plugs require to connect to the public electrical power distribution system in the exposed state in accordance with the rotatable and concealable electrical power receptacle 1*a* according to the present invention, users are comfortable and convenience to plug the electrical plugs of electronic devices into the electrical plug assemblies 18*a* without perform any additional actions in the exposed state. Furthermore, as the electronic devices are not in use, the rotatable and concealable electrical power receptacle 1*a* is capable of rotating in two dimensional directions transversely and perpendicularly to conceal the electrical plug assemblies 18*a* underneath the tabletop, i.e. in the concealed state, thereby the tabletop can be maintained in a final tidy appearance.

In the aspects of the aforementioned embodiments, the technical characteristics of the rotatable and concealable electrical power receptacle according to the present invention are applied to allow the electrical outlet assemblies concealed inside the receiving space or underneath the tabletop when not in use to maintain the overall surface of use to be smooth without uneven protrusions, thereby maintaining the operating space in a tidy appearance and increasing operating efficiency and space utilization. Additionally, the rotatable and concealable electrical power receptacle according to the present invention are capable of exposing the electrical outlet assemblies outside or out of the tabletop when in use, so that the plurality of power cables are able to connect to the concealable electrical outlet assemblies easily, thereby enhancing the comfort in use and the degree of convenience of use.

The aforementioned descriptions represent merely the preferred embodiment of the present invention, without any intention to limit the scope of the present invention thereto. Various equivalent changes, alterations, or modifications based on the claims of present invention are all consequently viewed as being embraced by the scope of the present invention.

What is claimed is:

1. A rotatable and concealable electrical power receptacle, comprising:

a main body;

an accommodating section, forming a receiving space inside, for receiving the main body;

a shaft section, being coupled to the main body and the accommodating section, comprising:

a first shaft member, being coupled to the main body and being rotatable along a axis of the first shaft member transversely, in which the main body is capable of rotating along the axis of the first shaft member transversely; and a second shaft member, being coupled to the accommodating section and the first shaft member, in which the axis of the first shaft member is perpendicular to a axis of the second shaft member and the first shaft member is capable of rotating with respect to the axis of the second shaft member transversely in accordance with the rotational movement of the second shaft member; and at least one electrical outlet assembly, being disposed on the main body.

2. The rotatable and concealable electrical power receptacle according to claim 1, further including an electrical power cable, being connected to the electrical outlet assembly and disposed inside the first shaft member.

3. The rotatable and concealable electrical power receptacle according to claim 1, further including a pulling member, being disposed on a periphery of the main body.

4. The rotatable and concealable electrical power receptacle according to claim 3, wherein the accommodating section incorporates with the pulling member to dispose an accommodating space for receiving the pulling member.

5. The rotatable and concealable electrical power receptacle according to claim 1, wherein the main body further includes:

a first housing member; and a second housing member, being coupled to the first housing member to form the main body.

6. The rotatable and concealable electrical power receptacle according to claim 5, wherein the electrical outlet assembly is disposed on the first housing member or the second housing member.

7. The rotatable and concealable electrical power receptacle according to claim 5, further including at least one USB jack assembly, at least one standard RJ11 connector, or at least one RJ45 connector, being disposed on the first housing member or the second housing member.

8. The rotatable and concealable electrical power receptacle according to claim 5, further including a power switch disposing on the second housing member or the first housing member for controlling the electrical power supply.

9. The rotatable and concealable electrical power receptacle according to claim 5, further including an indicator disposing on the second housing member or the first housing member for displaying the rotatable and concealable electrical power receptacle either in a conduction mode or in a cutoff mode.

10. The rotatable and concealable electrical power receptacle according to claim 5, wherein the receiving space is capable of receiving the main body entirely to allow an outer surface of either the first housing member or the second housing member aligned to the accommodating section in the same horizontal plane.

* * * * *